US005505644A

United States Patent [19]

Ousley, II et al.

[11] Patent Number: 5,505,644

[45] Date of Patent: Apr. 9, 1996

[54] SUBMERGED MARINE EXHAUST SYSTEM

[75] Inventors: Frank B. Ousley, II, Cocoa; Douglas A. Keehn, Jr., Merritt Island; William W. Powell; John R. Hamm, both of Cocoa, all of Fla.

[73] Assignee: Ray Industries, Inc., Knoxville, Tenn.

[21] Appl. No.: 374,228

[22] Filed: Jan. 18, 1995

[51] Int. Cl.[6] ..... B63H 21/32

[52] U.S. Cl. ..... 440/89

[58] Field of Search ..... 440/88, 89

[56] References Cited

U.S. PATENT DOCUMENTS 4,002,136 1/1977 Michalak .
4,019,456 4/1977 Harbert .
4,100,994 7/1978 Stuart .
4,509,927 4/1985 Ikeda .
5,078,631 1/1992 Harbert .
5,094,640 3/1992 Burdick et al. ..... 440/89
5,234,364 8/1993 Ito .
5,251,439 10/1993 Nakase et al. .
5,259,797 11/1993 Miles, Jr. et al. .

*Primary Examiner*—Stephen Avila
*Attorney, Agent, or Firm*—Malin, Haley, DiMaggio & Cosby

[57] ABSTRACT

An improved marine engine exhaust system for discharging engine exhaust above the water line when at idle or low speeds, and below the surface of the water at high speed in a submerged turbulent region generated by a hydrodynamic fitting fixed to a the undersurface of the vessel hull, wherein the gas is maintained for a period of time, until the low pressure area following the vessel has passed.

6 Claims, 7 Drawing Sheets

SUBMERGED MARINE EXHAUST SYSTEM

BACKGROUND OF THE INVENTION

1. Field of the Invention

The present invention relates to marine exhaust systems and more particularly to a marine exhaust system for discharging marine engine exhaust below the surface of the water.

2. Description of the Prior Art

Marine exhaust systems found on motorized vessels typically discharge engine exhaust through discharge ports located above the water line towards the rear of the vessel or stern. Marine engine exhaust comprises a mixture of gas and cooling water. Conventional marine exhaust systems, typically known as water lift mufflers include: an internal combustion engine having at least one exhaust manifold for ducting engine exhaust to a muffler wherein exhaust gas sound is attenuated, and an exhaust pipe originating at the muffler and terminating at a discharge opening in the hull, located proximate the stern. Engine exhaust is discharged toward the rear of the vessel and above the water line where, in theory, the gases are dissipated or carried away from the vessel.

There are a number of inherent disadvantages present in the conventional prior art marine exhaust systems and methods. Firstly, Engine exhaust must first pass through a muffler so that excessive noise may be attenuated prior to discharge. Since marine exhaust includes a corrosive mixture of gas and water, marine mufflers must be rugged and are known to add substantial cost and weight to vessels. Secondly, when a vessel is at idle, engine exhaust gas tends accumulate around the vessel since the discharge ports are sized for higher exhaust flow rates, and low flow exhaust flow rates, like those experienced at idle or low speed, are not discharged with sufficient velocity to completely clear the area. Thus, engine exhaust discharged through hull openings may accumulate in proximity to the vessel thereby irritating those on board, unless carried away or dissipated by prevailing winds. Thirdly, most motorized vessels that incorporate conventional marine exhaust systems suffer from a problem resulting from the low pressure area formed behind a moving vessel, often referred to as the "station wagon effect". Typically, a low pressure area, caused by the vessel structure moving through the atmosphere, develops near the stern of a vessel. Engine exhaust discharged near the stern of a moving vessel therefore, is caught in the resulting low pressure area and recirculates into the passenger compartment thereby irritating those on board. Since engine exhaust includes carbon monoxide gas, a high exhaust gas concentration circulating within the passenger compartment is extremely undesirable.

The prior art reveals a number of attempts directed toward overcoming the aforementioned problems. For example, U.S. Pat. No. 5,234,364 issued to Ito, discloses an EXHAUST SYSTEM FOR SMALL PLANING BOAT. Ito teaches an exhaust system having an exhaust pipe which terminates in a flush discharge opening formed in a lower surface of the hull for discharging engine exhaust through the body of water in which the watercraft is operating. The system incorporates an expansion chamber for silencing engine exhaust, and a low speed exhaust discharge line extending from the highest portion of the exhaust pipe, through the hull, to an area above the water level so as to provide a low speed exhaust discharge for discharging exhaust when the watercraft is operating at idle or low speeds. Discharging engine exhaust through a flush hull opening below the surface, however, causes the exhaust to flow with the fluid boundary layer formed by the water on the moving hull and results in the exhaust surfacing immediately behind the craft where the exhaust is likely to recirculate within the passenger compartment because of the aforementioned station wagon effect.

U.S. Pat. No. 5,078,631 issued to Harbert, also discloses a MARINE EXHAUST SYSTEM. Harbert discloses a marine exhaust system for separating the gas from the water of a gas/water mixture produced by a marine engine and expelling the gas a sufficient distance from the hull of a boat to place it outside of the turbulent boundary layer surrounding the hull and the low pressure area following behind the boat. Harbert, however, relies on an intricate variable exhaust gas discharge outlet that reduces the outlet opening area at low flow rates for projecting exhaust gases a maximum distance from a boat hull, and does not contemplate discharging exhaust gases below the surface of the water.

U.S. Pat. No. 4,509,927, issued to Ikeda, discloses a BOTTOM EXHAUST HIGH SPEED BOAT having a hull including a grooved bottom. Ikeda teaches an engine exhaust pipe extending into a midportion of the grooved bottom, and a duct fixed to the surface of the hull extending between the opening of the exhaust pipe and the front of the grooved bottom for transporting exhaust gases to the front of the grooved bottom whereby the grooved bottom is filled with exhaust gases thereby decreasing frictional resistance.

As has been described, the prior art has not overcome the aforementioned problems with marine engine exhaust. Thus, there still exists a need for a marine engine exhaust system for muffling a marine engine and discharging engine exhaust a sufficient distance from an idling vessel such that exhaust gas does not concentrate in proximity to the passenger compartment, and that discharges exhaust below the surface of the water, beyond the fluid boundary layer formed on the bottom of the hull while cruising, such that the discharged exhaust is further muffled and surfaces behind the low pressure area following the vessel thereby preventing recirculation within the passenger compartment.

SUMMARY OF THE INVENTION

The present invention contemplates an improved marine engine exhaust system for discharging exhaust, including a mixture of gas and water, above the water line when at idle or low speeds, and below the surface of the water at higher speeds in a turbulent region wherein the exhaust is maintained for a period of time, until the low pressure area following the vessel has passed, after which the exhaust surfaces and dissipates.

The marine exhaust system of the instant invention includes a marine engine having at least one exhaust manifold through which engine exhaust, including a mixture of gas and cooling water, flows. The exhaust manifold is in fluid communication with a means for ducting the exhaust from the engine. The engine exhaust is thus ducted from the engine to an accumulating means wherein exhaust sound is attenuated, thereby partially silencing exhaust noise, and the exhaust-borne water is allowed to pool.

The accumulating means incorporates primary and bypass exhaust outlets. The bypass exhaust outlet comprises a pipe penetrating the accumulating means wall at an angle and terminating a predetermined distance from the accumulating means floor. The bypass outlet is sized to handle all of the engine exhaust at idle and low engine speeds, and is connected by an exhaust hose to an exhaust discharge port located in the hull above the water line. The bypass handles all exhaust at idle since exhaust discharged below the hull tends to rock an idling vessel. The primary outlet originates at a liquid level low point on the accumulating means and extends downwardly through the hull bottom terminating in a hydrodynamic exhaust discharge means. The primary outlet is sized to handle the majority of exhaust gases at higher speeds when engine exhaust output exceeds the exhaust capacity of the bypass outlet.

The hydrodynamic exhaust discharge means, or fitting, is mounted to hull bottom and includes: a mounting flange for fixing the hydrodynamic exhaust means to the bottom of the hull; a downwardly extending foil means defining an exhaust channel; and, a hydroconical exhaust discharge in fluid communication with said foil means. The hydrodynamic exhaust discharge means is shaped such that the downwardly extending foil creates less drag, and hence less turbulence in its wake, than the hydroconical exhaust discharge. As a result, when the vessel travels through the water discrete turbulence layers are formed below the hull undersurface by water passing around the hydrodynamic exhaust fitting.

Hydrodynamic forces operating on the fitting also cause the formation of an area of low pressure proximate the hydroconical exhaust discharge outlet, that, when combined with an increase in exhaust system pressure resulting from higher engine exhaust output, allow engine exhaust to exit the vessel below the surface of the water through the hydroconical exhaust discharge. Engine exhaust is thus discharged in a turbulent region formed by the hydroconical portions wake, and entrapped, thereby maintaining the exhaust below the surface for a period of time such that when the exhaust finally surfaces the vessel is a sufficient distance from the point of exhaust surfacing as not to induce exhaust gas recirculation within the passenger compartment.

Therefore, when the marine engine is started, engine exhaust, including a mixture of exhaust gas and cooling water, is ducted to an accumulating means wherein the water pools. At idle or low speed, engine exhaust entrains water from the accumulator floor, thereby silencing and cooling the engine exhaust, and exits the accumulator through the bypass outlet whereafter the exhaust is discharged out the side of the vessel, at sufficient velocity so as to project the exhaust away from the vessel in a conventional manner. As the engine is throttled up and the vessel begins moving through the water, the exhaust pressure increases and the hydrostatic pressure at the submerged discharge outlet decreases due to hydrodynamic forces. At a point, depending upon the specific hydrodynamic design, but usually about 10–15 knots, the pressure at the submerged exhaust outlet decreases, while exhaust system pressure increases, until the exhaust back pressure overcomes hydrostatic forces thereby allowing exhaust to flow out of the submerged exhaust outlet. The discharged exhaust is trapped for a period of time in the resulting turbulent region generated by the shape of the hydrodynamic fitting. The exhaust remains submerged, until the top side low pressure area following behind the vessel has passed, thereby preventing exhaust from recirculating within the passenger compartment.

In accordance with the instant invention, it is an object thereof to provide an improved marine engine exhaust system for discharging engine exhaust below the surface of the water.

It is a further object of the instant invention to provide a marine engine exhaust system for discharging exhaust below the surface of the water in a buoyancy retarding turbulent region.

Still another object of the present invention is to provide a marine engine exhaust system that eliminates the need for a conventional marine muffler.

Yet another object of the present invention is to provide a marine engine exhaust system, having no moving parts, that discharges exhaust above the surface while at idle and low speeds, and discharges the majority of exhaust below the surface in a turbulent region at high speeds.

A further object of the present invention is to provide a marine engine exhaust system wherein hydrodynamic forces acting proximate a submerged exhaust outlet function in combination with exhaust system pressure to allow the discharging of engine exhaust below the surface of the water.

In accordance with these and other objects which will become apparent hereinafter, the instant invention will now be described with particular reference to the accompanying drawings.

DESCRIPTION OF THE PREFERRED EMBODIMENTS

Figure 1:
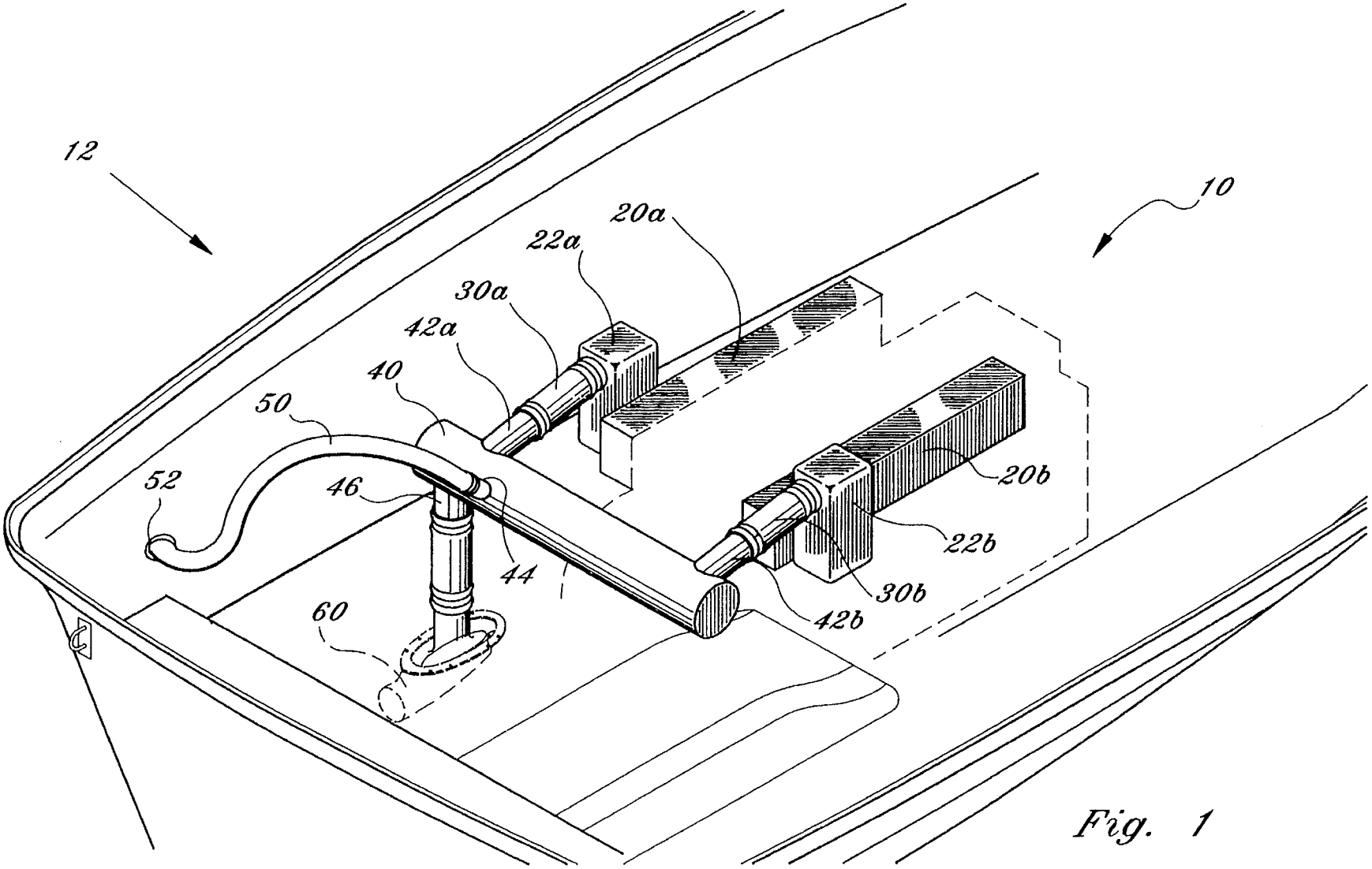
FIG. 1 depicts a perspective view of the instant invention mounted in a vessel hull and connected to an engine exhaust manifold.

Turning first to FIGS. 1–4, the marine exhaust system of the instant invention includes a marine engine 10, having cylinder banks in a conventional V configuration, mounted in a marine vessel, generally designated 12. Each cylinder bank incorporates an exhaust manifold 20*a* and 20*b*, through which engine exhaust, including a mixture of gas and cooling water flows. Each exhaust manifold is in fluid communication with a means for ducting the exhaust from the engine, 30*a* and 30*b*, via exhaust risers 22*a* and 22*b*. Engine exhaust thus flows through piping 30*a* and 30*b* from the engine to an exhaust accumulator 40. In the preferred embodiment, as best depicted in FIG. 2, accumulator 40 is formed from an elongated cylinder forming a chamber and having a pair of exhaust inlets 42*a* and 42*b*, a bypass outlet 44 disposed between inlets 42*a* and 42*b*, and a primary outlet 46. Exhaust accumulator 40 functions to attenuate exhaust sound thereby silencing the engine exhaust. In addition, accumulator 40 functions to collect cooling water discharged by engine 10 and carried by exhaust gases. Water entering accumulator 40 through inlets 42*a* and 42*b* thus collects in the accumulator forming a liquid floor.

Figure 2A:
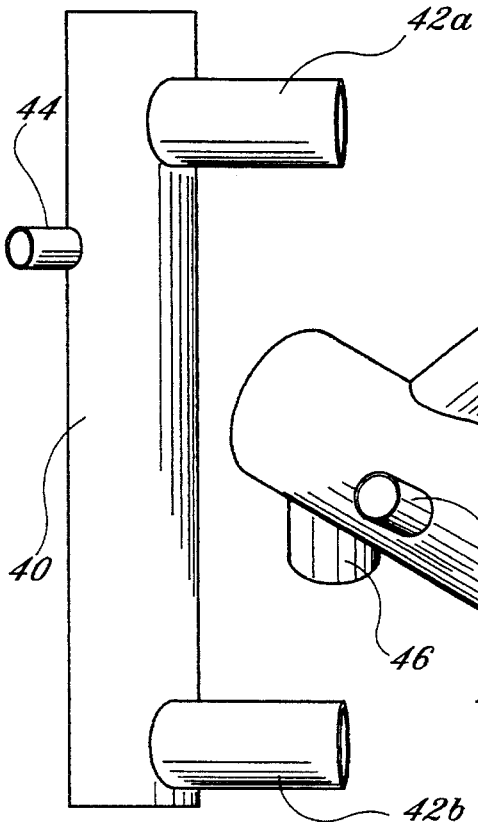
FIG. 2A depicts the exhaust accumulator in plan view.
Figure 2B:
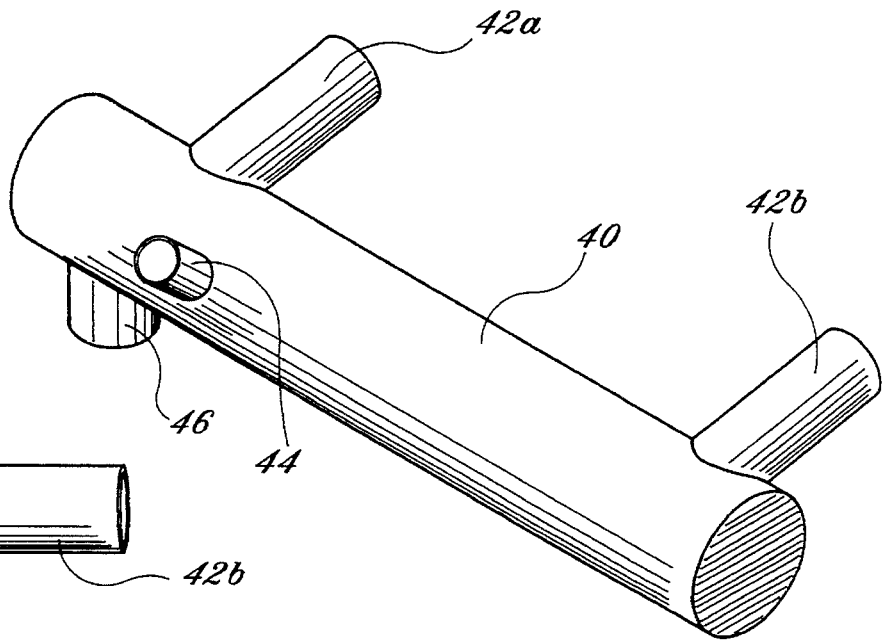
FIG. 2B depicts the exhaust accumulator in perspective view.
Figure 2C:
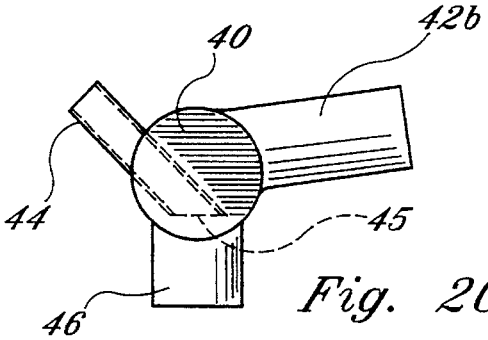
FIG. 2C depicts a side view of the exhaust accumulator.
Figure 2D:
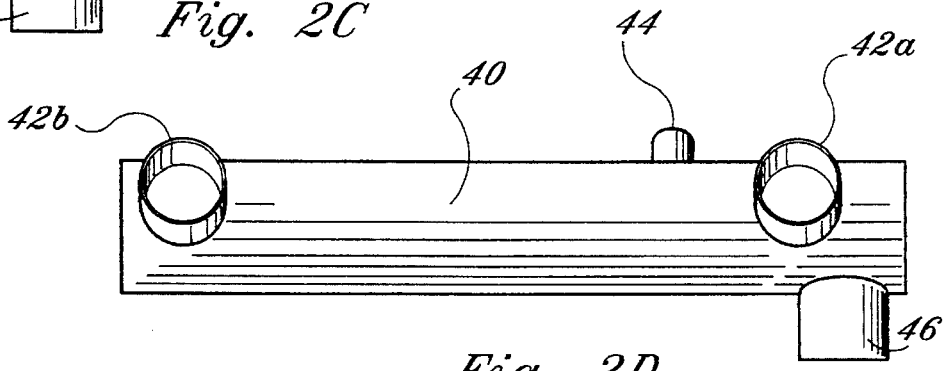
FIG. 2D depicts a rear view of the exhaust accumulator.
Figure 3A:
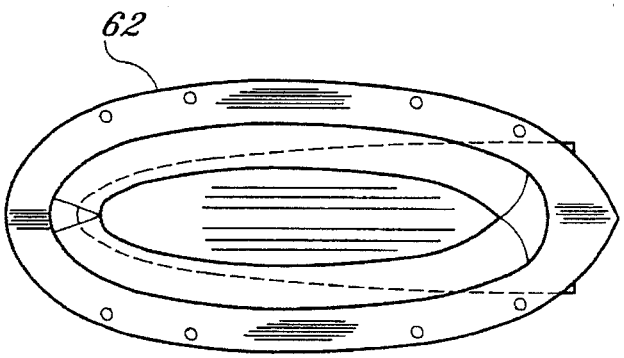
FIG. 3A depicts the submerged hull mounted hydrodynamic exhaust discharge fitting in plan view.
Figure 3B:
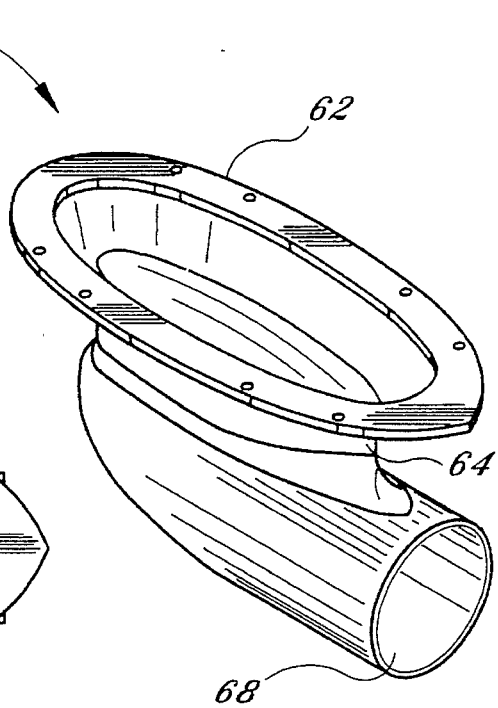
FIG. 3B depicts the submerged hull mounted hydrodynamic exhaust discharge fitting in perspective view.
Figure 3C:
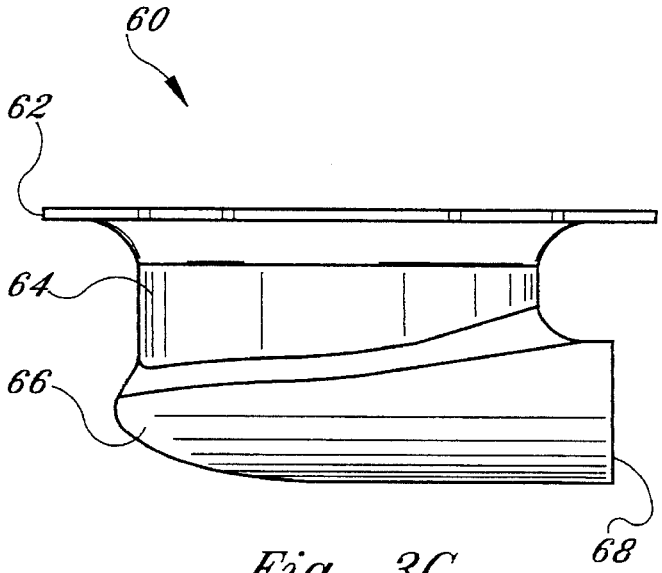
FIG. 3C depicts a side view of the submerged hull mounted hydrodynamic exhaust discharge fitting.
Figure 3D:
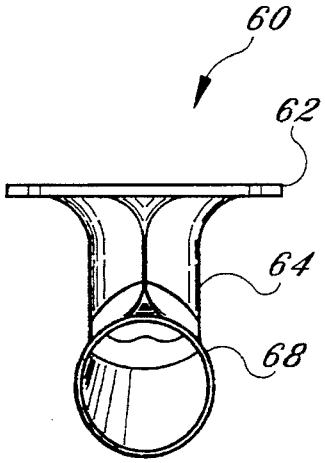
FIG. 3D depicts a rear view of the submerged hull mounted hydrodynamic exhaust discharge fitting.

The accumulator bypass exhaust outlet 44 comprises a section of pipe penetrating the accumulator 40 wall at an angle and terminating a predetermined distance from the accumulator floor as best depicted in FIG. 2C. Exhaust outlet 44 thus originates within accumulator 40 at an opening 45 existing on a substantially horizontal plane within inches of the liquid floor. Exhaust outlet opening 45 is so configured and positioned relative to the floor of the accumulator to facilitate removal of water collected on the accumulator floor by entrainment with flowing exhaust gas. Bypass outlet 44 is sized to handle all of the engine exhaust at idle and low engine speeds, and is connected by an exhaust hose 50 to an exhaust discharge port 52 located in the hull above the water line substantially toward the vessel's rear or transom.

A primary outlet 46 originates at a liquid level low point on the accumulator and extends downwardly. An exhaust pipe 48 is connected to outlet 46 and extends downwardly through the bottom of the hull. Primary exhaust outlet 46 is sized to handle the majority of the engine exhaust at higher speeds when engine exhaust output exceeds the exhaust capacity of bypass outlet 44.

A hydrodynamic exhaust means comprising a discharge fitting 60, as best seen in FIGS. 3A–D and FIG. 4, is fixed to the bottom of the hull by stainless steel fasteners 61, and is in fluid communication with accumulator 40 via primary outlet 46 and exhaust pipe 48. Hydrodynamic exhaust discharge fitting 60 is mounted to the bottom of the hull and includes: a mounting flange 62 for fixing the hydrodynamic fitting to the bottom of the hull; and, a downwardly extending streamlined foil section 64 terminating in a hydroconical shaped exhaust discharge outlet having a leading surface 66 and an exhaust outlet 68. In the preferred embodiment the hydroconical exhaust discharge is bullet shaped. The hydrodynamic exhaust discharge fitting is structured such that the downwardly extending foil section 64 creates less drag than the bullet shaped discharge structure 68. As a result, when the vessel is moving, turbulent regions are formed below the hull by hydrodynamic fitting 60, and particularly by foil section 64 and bullet discharge 68. Since the bullet shaped exhaust discharge 68 is less streamlined than is foil section 64, the bullet 68 generates greater turbulence in its wake thereby creating a discrete, highly turbulent region, separated from the bottom of the hull by a region of substantially less turbulence that is created by foil section 64.

Furthermore, the hydrodynamic forces operating on the fitting effectively lower the hydrostatic pressure at outlet 68, that, when combined with an increase in exhaust system pressure resulting from higher engine output and the limited capacity of bypass outlet 44, allows exhaust gases to exit the vessel below the surface of the water through the hydrodynamic fitting 60 via discharge 68 by overcoming the hydrostatic back pressure. The exhaust is thus discharged in the turbulent region formed by the hydroconical sections wake and entrapped, thereby maintaining the exhaust below the surface for a period of time such that when the exhaust finally surfaces the vessel is a sufficient distance from the point of exhaust surfacing as not to induce exhaust gas recirculation within the passenger compartment.

Therefore, when the marine engine of a vessel incorporating the instant invention is started, engine exhaust including a mixture of gas and cooling water, is ducted from engine manifolds 20*a* and 20*b* to accumulator 40 by exhaust pipes 30*a* and 30*b* connected to accumulator exhaust inlets 42*a* and 42*b*, wherein exhaust noise is attenuated and water collects on the accumulator floor. At idle or low engine speeds, engine exhaust entrains, or scavenges, water from the accumulator floor, thereby further silencing and cooling the engine exhaust, and exits the accumulator 40 via bypass outlet 44 whereafter the exhaust is carried by exhaust hose 50 to a discharge outlet 52 located on the vessel side above the water line. Discharge outlet 52 is sized such that exhaust discharge velocity carries exhaust a sufficient distance from the vessel to prevent recirculation within the passenger compartment. Exhaust is prevented from exiting primary outlet 46 since the exhaust back pressure is not sufficient to overcome the hydrostatic pressure existing at hydrodynamic discharge outlet 68.

Figure 7A:
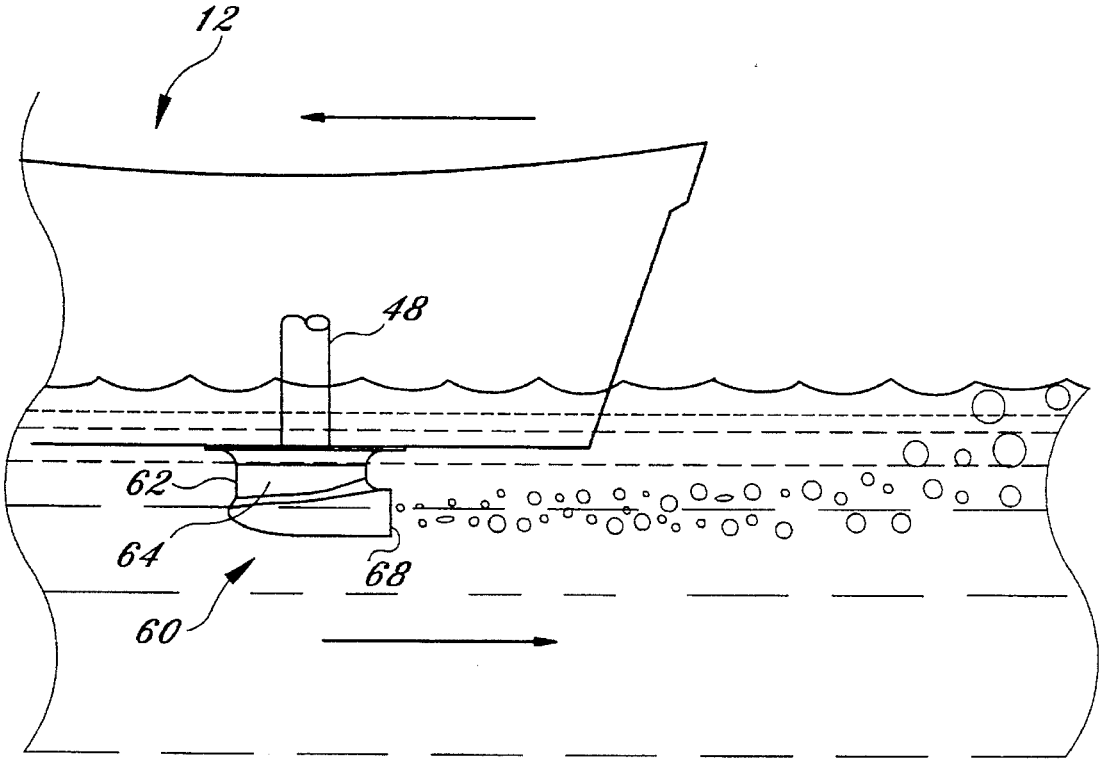
FIG. 7A illustrates exhaust flowing out of the submerged hydrodynamic exhaust discharge fitting of the instant invention.
Figure 7B:
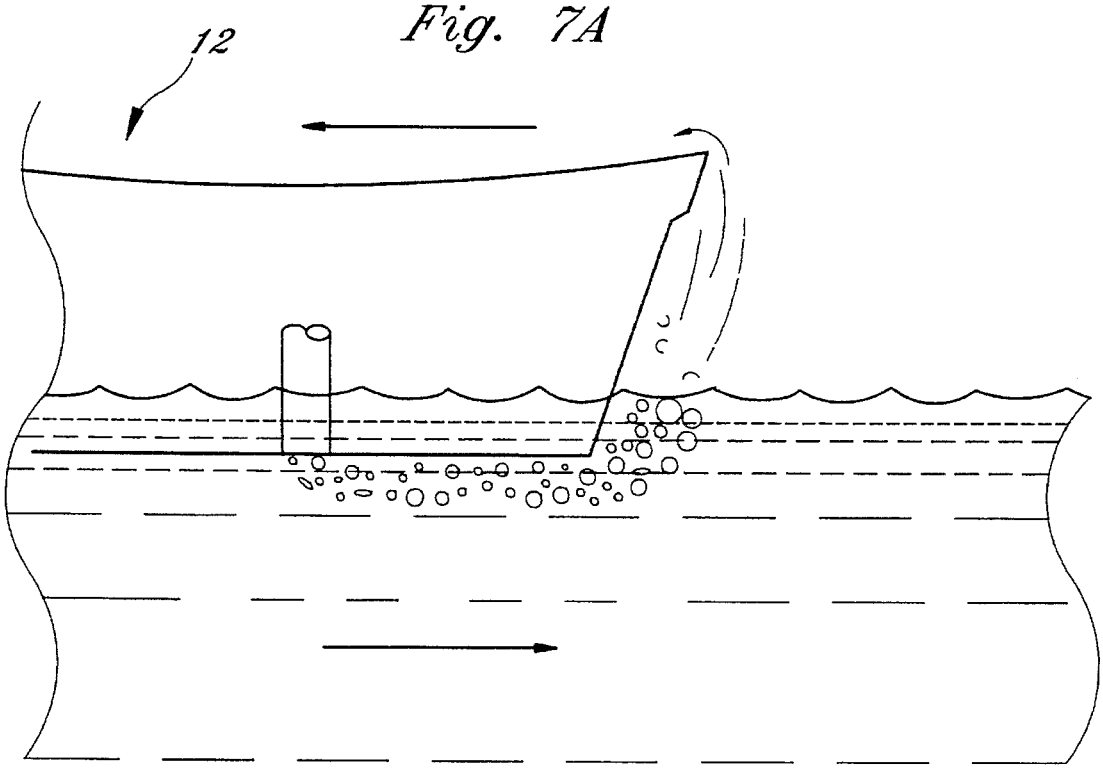
FIG. 7B illustrates exhaust flowing out of a flush hull bottom opening and recirculating within the passenger compartment.

As the engine is throttled up and the vessel moves through the water with increasing speed, the volume of exhaust generated by the engine increases causing an increase in the overall exhaust system pressure. Furthermore, the pressure at discharge outlet 68 decreases due to hydrodynamic forces. As best depicted in FIG. 7A, at a design point of 10–15 knots, the exhaust system pressure rises, and the hydrostatic pressure at the submerged discharge outlet 68 decreases, until the exhaust back pressure overcomes hydrostatic forces thereby allowing majority of exhaust to flow out of the submerged discharge outlet 68 via primary outlet 46, exhaust pipe 48, and fitting 60. The discharged exhaust is trapped, for a period of time, in the resulting submerged turbulent region produced by the hydroconical bullet 68 wake, surfacing only after the low pressure area following the vessel has passed. In contrast, as best depicted in FIG. 7B, exhaust discharged out of a flush hull opening would flow along the hull surfacing closely behind the vessel where it would recirculate in the low pressure area following the vessel.

An alternate embodiment for engines with in-line cylinders having a single exhaust manifold is depicted in FIGS. 5A–5D and FIG. 6. In this embodiment a marine power plant 10, such as a diesel engine, having in-line cylinders forming a single cylinder bank, is mounted in a vessel 12. A single exhaust manifold 20 directs engine exhaust, including a mixture of gas and water, to exhaust piping 30 via an exhaust riser 22. This embodiment incorporates an accumulator, generally designated 70, having a single exhaust inlet 72 and bypass and primary exhaust outlets, 74 and 76 respectively. Accumulator 70 has an expanded body portion 78 disposed between exhaust inlet 72 and primary outlet 76, and is connected to inlet 72 and outlet 76 by transition sections 79*a* and 79*b*.

Figure 4:
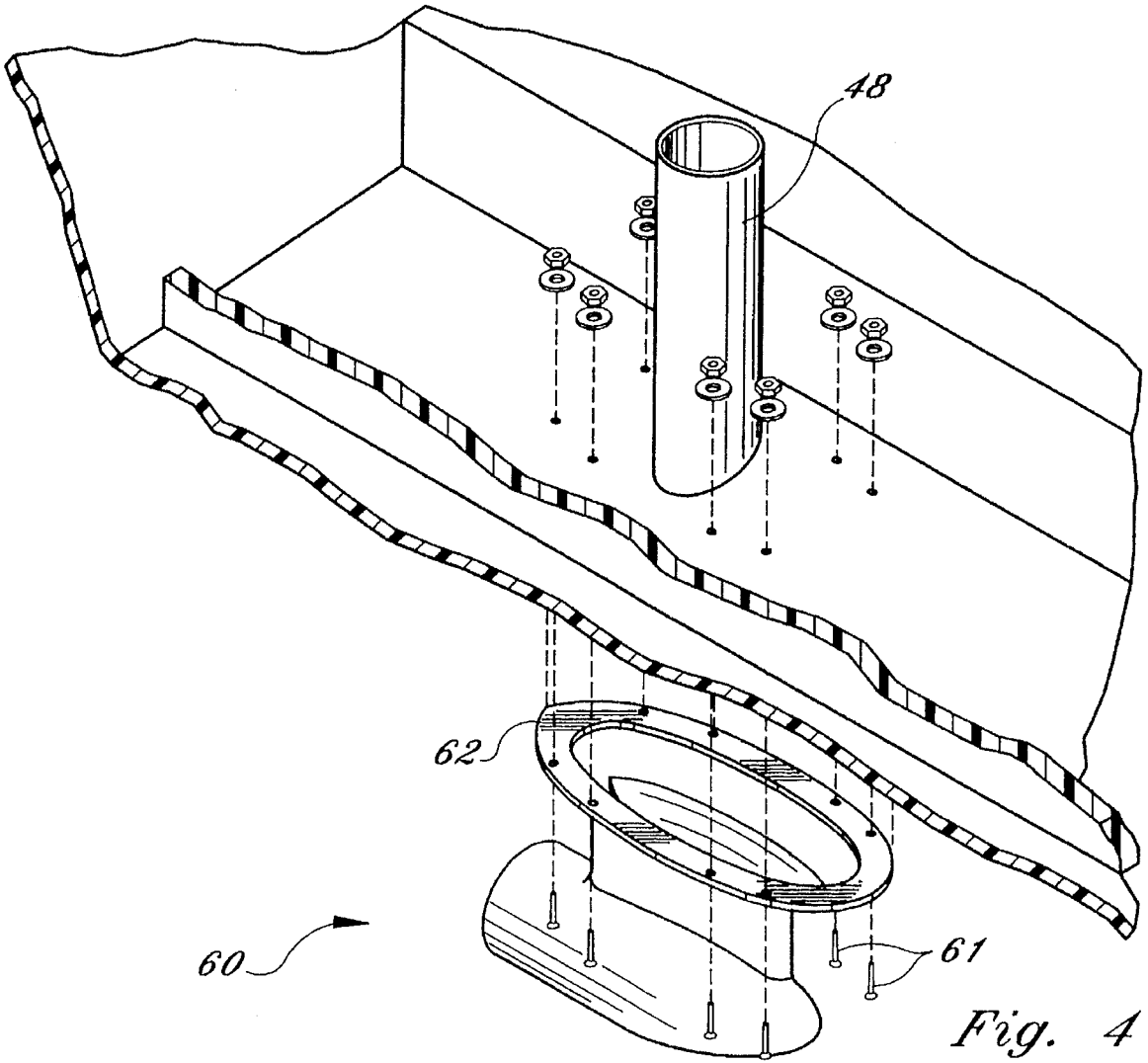
FIG. 4 depicts an exploded view of the submerged hull mounted hydrodynamic exhaust fitting and a partial vessel hull in section.
Figure 5A:
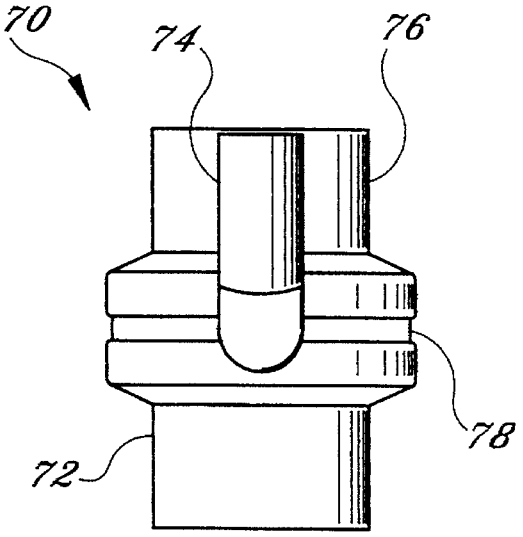
FIG. 5A depicts an alternate embodiment of the exhaust accumulator, for use with engines having a single exhaust manifold, in plan view.
Figure 5B:
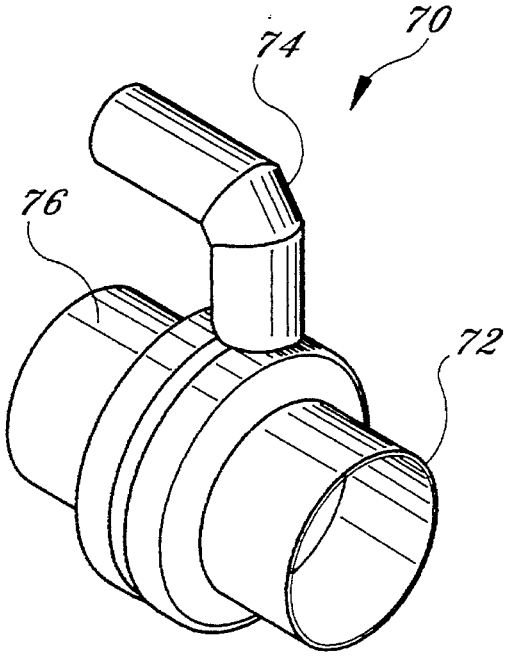
FIG. 5B depicts the alternate embodiment accumulator of FIG. 5A in perspective view.
Figure 5C:
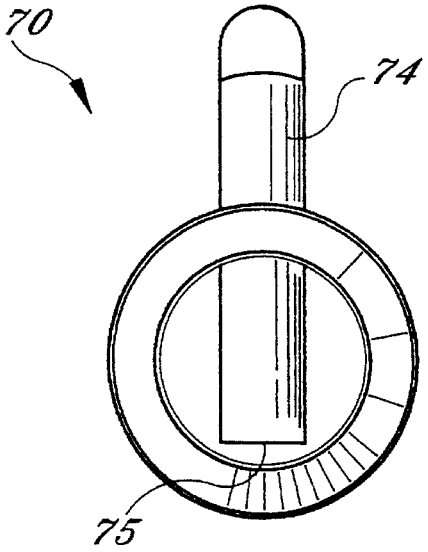
FIG. 5C depicts a rear view of the alternate embodiment accumulator of FIG. 5A.
Figure 5D:
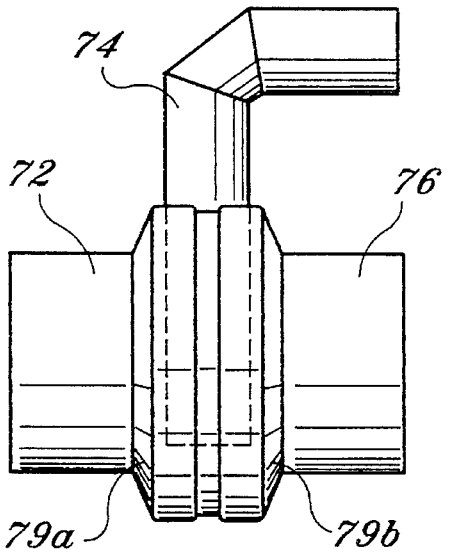
FIG. 5D depicts a right side view of the alternate embodiment accumulator of FIG. 5A.
Figure 6:
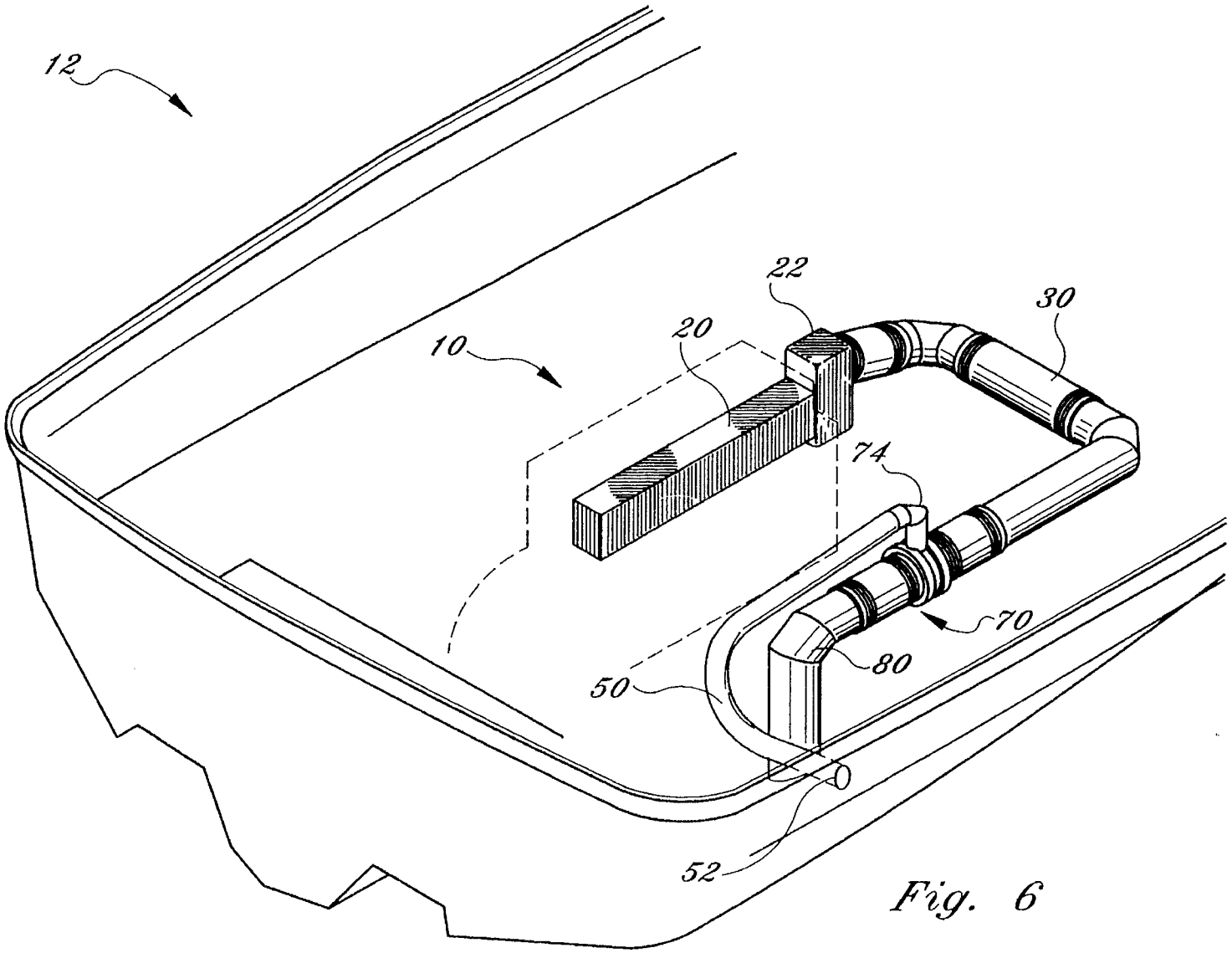
FIG. 6 depicts the instant invention installed on a marine engine having in-line cylinders with a single exhaust manifold.

Bypass outlet 74 includes a tubular exhaust pipe partially inserted in accumulator expanded body portion 78 disposed between transition sections 79*a* and 79*b* as best depicted in FIGS. 5C and 5D. Body portion 78 has an expanded cross-sectional area to compensate for the loss of free area, or obstruction, caused by the insertion of tubular exhaust pipe 74. Bypass exhaust outlet 74 originates at outlet opening 75 located proximate the body portion 78 floor. Bypass exhaust outlet opening 75 is so configured and positioned relative to the body floor to facilitate removal of water collected on the body floor by entrainment with flowing exhaust gas. Bypass outlet 74 is connected by exhaust hose 50 to a hull discharge outlet 52 located above the water line near the transom. Exhaust pipe 80 connects to outlet 76 and extends downwardly through the hull bottom. Primary exhaust outlet 76 is sized to accommodate the majority of exhaust at higher speeds when engine exhaust output exceeds the exhaust capacity of bypass outlet 74. A hydrodynamic exhaust discharge fitting as previously described (not shown in FIG. 6) is fixed to the bottom of the hull by stainless steel fasteners, as best depicted in FIG. 4, and is in fluid communication with exhaust pipe 80.

Therefore, when the marine engine of a vessel incorporating the alternate embodiment of instant invention is started, engine exhaust including a mixture of exhaust gas and cooling water, is ducted from the engine manifold 20 to accumulator 70, via exhaust riser 22 and exhaust piping 30 connected to accumulator exhaust inlet 72, wherein exhaust noise is attenuated and water collects. At idle or low speeds, engine exhaust entrains, or scavenges water from the accumulator floor, thereby further silencing and cooling the engine exhaust, and exits the accumulator 70 via bypass outlet 72 whereafter the exhaust is carried by exhaust hose 50 to a discharge outlet 52 located above the water line on the vessel side proximate the transom. Discharge outlet 52 is sized such that exhaust velocity carries exhaust a sufficient distance from the vessel to prevent recirculation within the passenger compartment. Exhaust is prevented from exiting primary outlet 76 since the exhaust back pressure is not sufficient to overcome the hydrostatic pressure existing at the hydrodynamic fitting discharge 68.

As the engine is throttled up and the vessel begins moving through the water, the exhaust flow rate increases causing an increase in the overall exhaust system pressure. Furthermore, the pressure at discharge outlet 68 decreases due to hydrodynamic forces acting on the fitting as previously described. As best depicted in FIG. 7A, at a design point of 10–15 knots, the pressure at the submerged discharge outlet decreases to a point where the exhaust back pressure overcomes hydrostatic forces thereby allowing bulk of exhaust to flow out of the submerged discharge outlet 68. The submerged exhaust is trapped for a period of time in the resulting turbulent region in the bullet outlet 68 wake, surfacing only after the low pressure area following the vessel has passed, as previously described. In contrast, as best depicted in FIG. 7B, exhaust discharged out of a flush hull opening would flow along the hull surfacing closely behind the vessel where it would recirculate in the low pressure area following the vessel.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An exhaust system for use with a marine engine mounted in a vessel, said vessel having a hull with an undersurface that is submerged when said vessel is placed within a body of water, said exhaust system comprising:

means for ducting engine exhaust including both gas and cooling water;

means for accumulating said engine exhaust, said means for accumulating including an inlet means for receiving said engine exhaust from said ducting means, a primary outlet means for expelling said engine exhaust through said vessel hull, and a bypass means for expelling engine exhaust to the surrounding atmosphere, said bypass means being a low flow rate outlet such that exhaust gas flowing through said bypass means entrains water pooled in said accumulating means thereby providing a baffling means for silencing engine exhaust noise; and said primary outlet means being a high flow rate outlet in communication with said body of water at a submerged location; said primary outlet means communicating with a submerged hydrodynamic exhaust outlet means fixed to said hull undersurface;

said hydrodynamic exhaust outlet means including a downwardly extending streamlined first section having a low coefficient of drag for minimizing turbulent wake, said first section terminating in a second section having a higher coefficient of drag for generating a submerged layer of turbulent wake separated from the bottom of the hull by a region of substantially less turbulence created by said first section, said second section incorporating a submerged exhaust outlet, for discharging exhaust in said submerged turbulent layer such that said exhaust remains submerged until said vessel has cleared the vicinity.

2. An exhaust system for use with a marine engine according to claim 1, wherein said hydrodynamic exhaust outlet means comprises a hydroconical means in communication with a foil means, said foil means disposed between said hydroconical means and said hull undersurface and in communication with said primary outlet means.

3. An exhaust system for use with a marine engine according to claim 1, wherein said hydrodynamic exhaust outlet means comprises a fitting defining an exhaust passage and having a flange for fixing said fitting to said hull, a bullet-shaped member having an exhaust outlet, and a foil member disposed between said hull and said bullet-shaped outlet.

4. An exhaust system for use with a marine engine mounted in a vessel, said vessel having a hull with an undersurface that is submerged when said vessel is placed in a body of water, said exhaust system comprising:

at least one exhaust manifold and a marine exhaust riser for receiving engine exhaust including gas and cooling water, from said engine;

exhaust piping in communication with said manifold;

an accumulator defining an exhaust accumulating chamber, said accumulator having an exhaust inlet in communication with said exhaust piping, a primary outlet and a bypass outlet;

said accumulator bypass outlet sized for low exhaust flow rates and in communication with the surrounding atmosphere;

said accumulator primary outlet, communicating with a submerged hydrodynamic fitting for discharging exhaust in a submerged location below said hull;

said hydrodynamic fitting fixed to said hull and including a downwardly extending streamlined first section terminating with a turbulent wake generating second section defining a submerged exhaust outlet for discharging exhaust in a submerged turbulent layer whereby discharged exhaust remains submerged until said vessel has cleared the vicinity.

5. An exhaust system for use with a marine engine mounted in a vessel, said vessel having a hull with an undersurface that is submerged when said vessel is placed within a body of water, said exhaust system comprising:

a pair of exhaust manifolds each incorporating a marine exhaust riser for receiving exhaust, including gas and cooling water, from said engine;

an accumulator having first and second exhaust inlets for receiving engine exhaust from said manifolds;

a pair of exhaust ducts each fluidly connecting an exhaust manifold to one of said accumulator inlets;

said accumulator having a bypass outlet, in communication with an ambient discharge port located in said hull, and sized to accommodate all low speed engine exhaust;

said accumulator having a primary outlet, sized to accommodate engine exhaust produced at high speed, and in communication with a submerged hydrodynamic fitting for discharging exhaust in a submerged location below said hull;

said hydrodynamic fitting fixed to said hull undersurface and including a downwardly extending streamlined section having a low coefficient of drag for minimizing turbulent wake terminating in a second section having a high coefficient of drag for generating a submerged layer of turbulent wake, said second hydrodynamic fitting section incorporating a submerged exhaust outlet, for discharging exhaust in said submerged turbulent layer such that said exhaust remains submerged until said vessel has cleared the vicinity.

6. An exhaust system for use with a marine engine mounted in a vessel, said vessel having a hull with an undersurface that is submerged when said vessel is placed within a body of water, said exhaust system comprising:

means for ducting engine exhaust including both gas and cooling water;

means for accumulating said engine exhaust, said means for accumulating including an inlet means for receiving said engine exhaust from said ducting means, a primary outlet means for expelling said engine exhaust through said vessel hull, and a bypass means for expelling engine exhaust to the surrounding atmosphere, said bypass means being a low flow rate outlet such that exhaust gas flowing through said bypass means entrains water pooled in said accumulating means thereby providing a baffling means for silencing engine exhaust noise; and said primary outlet means being a high flow rate outlet in communication with a hydrodynamic exhaust outlet means comprising a fitting defining an exhaust passage and having a bullet-shaped member with a submerged exhaust outlet, and a foil member disposed between said hull and said bullet-shaped outlet, such that said engine exhaust flowing through said primary outlet means is discharged below said hull.

* * * * *